United States Patent [19]

Hamblin

[11] 3,991,934

[45] Nov. 16, 1976

[54] LETTER PLATES

[75] Inventor: Richard David Hamblin, Birmingham, England

[73] Assignee: Archibald Kenrick and Sons Limited, England

[22] Filed: Apr. 17, 1975

[21] Appl. No.: 568,911

[52] U.S. Cl. ..... 232/46; 16/171

[51] Int. Cl.[2] ..... A47H 33/00

[58] Field of Search ..... 232/46, 45, 44; 16/171

[56] References Cited

UNITED STATES PATENTS

| | | | |
|---|---|---|---|
| 2,365,378 | 12/1944 | Benson | 16/171 |
| 3,389,854 | 6/1968 | Coopersmith | 232/46 |

FOREIGN PATENTS OR APPLICATIONS

| | | | |
|---|---|---|---|
| 954,132 | 4/1964 | United Kingdom | 232/45 |
| 1,071,316 | 6/1967 | United Kingdom | 232/45 |

*Primary Examiner*—J. Franklin Foss

*Attorney, Agent, or Firm*—Andrus, Sceales, Starke & Sawall

[57] ABSTRACT

A letter plate comprising an extruded flap and an extruded frame, the flap and the frame having respective inter-engaging hinge formations which form parts of the respective extruded sections, the flap in one example having an integral lengthwise extending enlargement occupying a correspondingly shaped recess extending lengthwise of the frame.

2 Claims, 8 Drawing Figures

LETTER PLATES

This invention relates to letter plates of the kind comprising a flap pivotally mounted on a frame which defines an opening, normally covered by the flap, to register with a similar opening in a door or other structure to which the letter plate may be fixed, the flap and frame being constructed from respective extruded members.

It is the object of the invention to provide a letter plate which is particularly convenient to manufacture and effective in use.

According to the present invention a letter plate comprises an extruded flap and an extruded frame having respective interengaging pivot formations forming parts of the respective extruded sections.

Figure 1:
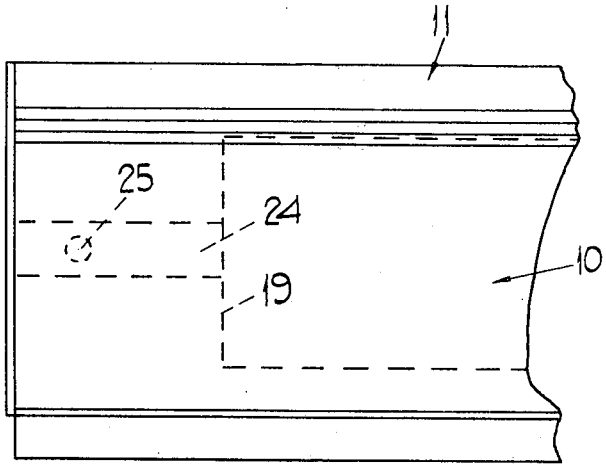
Figure 3:
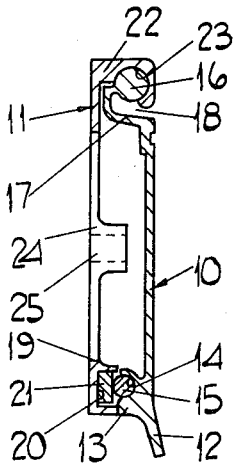
Figure 2:
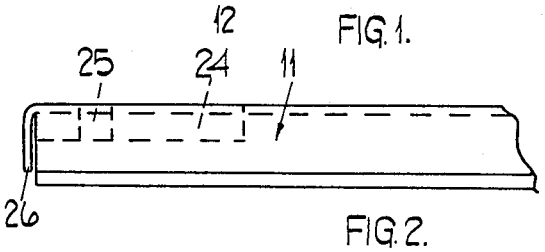
Figure 4:
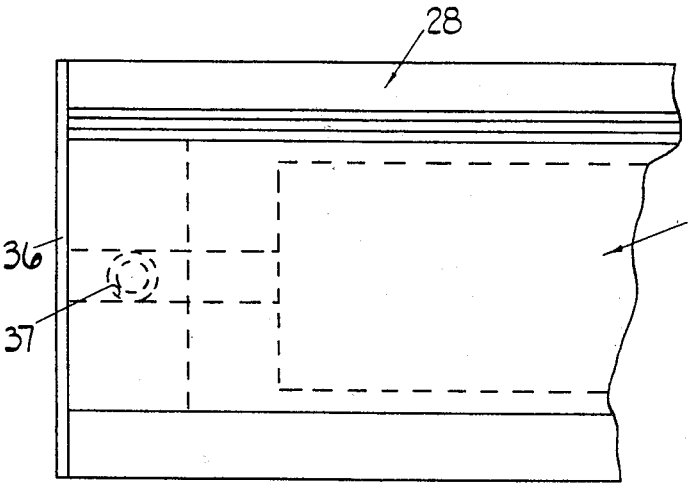
Figure 6:
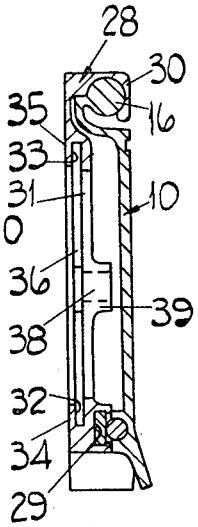
Figure 5:
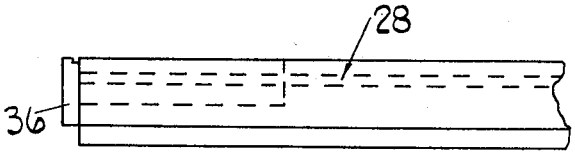
Figure 7:
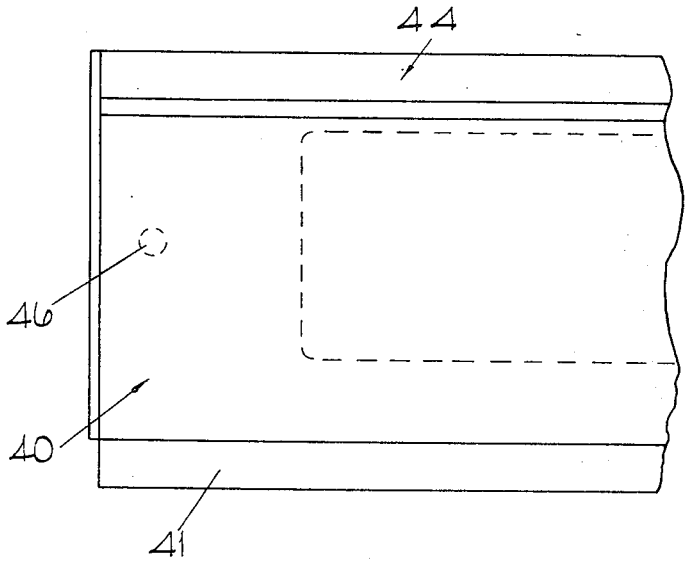
Figure 8:
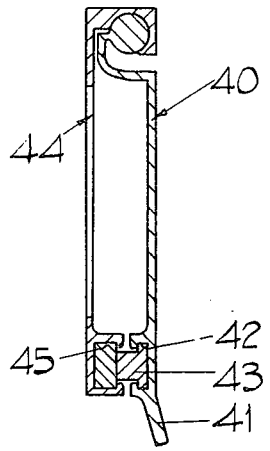

The invention will now be described by way of example with reference to the accompanying drawings in which FIG. 1 is a front view of a letter plate constructed in accordance with the invention, FIG. 2 is an edge view, FIG. 3 is a cross sectional view, FIG. 4 is a front view of an alternative form of letter plate, FIG. 5 is an edge view thereof, FIG. 6 is a cross sectional view thereof, FIG. 7 is a front view of a further alternative form of letter plate and FIG. 8 is a cross sectional view thereof.

With reference to the construction shown in FIGS. 1, 2 and 3, the letter plate comprises a generally rectangular extruded flap 10, pivotally mounted in an extruded frame 11. The extruded flap 10, which is shown in cross section in FIG. 3, is a generally rectangular plate with of course uniform cross section. At one edge, the flap 10 has a slightly inclined flange 12, adjacent to which is an enlargement 13 defining a semi-cylindrical groove 14. In the groove intermediate the end of the flap is a length of iron rod 15. The length of this rod 15 is, for example, 1 inch.

The other edge of the flap 10 is provided at its extremity with an integral cylindrical portion 16 connected to the remainder of the flap 10 by a curved portion 17 whereby the cylindrical portion 16 is spaced from the edge of the main portion of the flap by a deep recess 18.

The frame 11 has a rectangular opening 19 corresponding in use to an opening in a door or other structure to which the letter plate is fixed. One edge of the frame has a lipped channel shaped groove 20 which at a position intermediate the ends of the frame contains a magnet 21. The length of the magnet 21 is equal or substantially equal to the length of the iron rod 15 which is positioned to engage therewith and to form a keeper for it. The rod 15 and the magnet 21 are therefore aligned laterally of the letter plate and also lengthwise thereof. This arrangement is intended to hold the flap 10 in its closed position to prevent rattle resulting from draughts flowing through the letter plate.

To retain the iron rod 15 and the magnet 21 in their respective grooves 14 and 20, the margins of said grooves are locally deformed.

At the other edge the frame 11 is provided with a flanged portion 22 comprising first and second flanges, which define a part cylindrical recess 23 of a size and shape to receive and engage the cylindrical portion at the adjacent edge of the flap 10. The recess 23 in the frame flange portion 22 is greater than half a cylinder so that the cylindrical portion 16 is retained therein but can swivel to allow the flap 10 to be raised to expose the opening 19 in the frame 11.

At its ends the frame 11 has integral ribs 24 in which are formed holes 25 for fixing screws.

The extremities of the frame 11 are moreover bent up to seal the ends of the letter plate as shown in FIG. 2 at 26. In order to allow such end to be bent up, it is necessary to remove the projections on the extrusion which forms the frame 11, such projections comprising the flanges at opposite sides of the groove 20, the flanged portion 22 and the portion 24 containing the screw access holes 25.

The flap 10 is engaged lengthwise in the frame 11 and the bent up end portions 26 are formed after such assembly and preferably before treatment such as anodising is completed.

In the construction shown in FIGS. 4, 5 and 6, there is a flap 10 which is identical with that of FIGS. 1, 2 and 3. The flap is hingedly mounted in a similar manner to the other construction in a frame 28. The cross section form of this is shown in FIG. 6. At one edge it has a magnet receiving groove 29 and at the other edge a flanged portion 30 for receiving the cylindrical portion 16 of the flap 10. The shape of the cross section of the extrusion includes a wall identified at 31 separated by a pair of longitudinal grooves 32, 33 from a pair of flanges 34, 35, which are directed towards one another and are in the same plane. Located in the recesses formed by such grooves 32, 33 are separate end members 36. Each of these end members comprises a tongue engaging in the grooves 32, 33, and a rectangular portion forming an end for the letter plate.

Holes 37 in the tongues are aligned with holes 38 in the portion 39 of the extrusion equivalent to the portion 24 in FIGS. 1 to 3 constructions. These end members 36 are preferably made from a material such as plastics or metal and are held in place in use by means of the fixing screws used to hold the letter plate itself upon the door or other structure. In the further construction shown in FIGS. 7 and 8 there is a flap 40 of similar form to the flap 10. However at the edge of the flap 40 which has a slightly inclined flange 41, there is formed a lipped channel shaped groove 42. In the groove 42, intermediate the ends of the flap 40, is a length of iron bar 43. The bar is of T-shape in cross section and the lips of the groove 42 are locally deformed to retain the rod therein.

The flap 40 is hingedly mounted in a frame 44, in a similar manner to the other constructions. At one edge the frame has a magnet receiving groove 45.

At its ends, the frame 44 is provided with holes 46 for fixing screws.

The extremities of the frame 44 are bent up to seal the ends of the letter plate.

I claim:

1. A letter plate comprising an extruded flap and a planar extruded frame having an opening formed therein, said frame being formed, at one edge thereof, with a first integral flange portion extending normally from the plane of said frame and a second integral flange portion extending normally from said first integral flange portion, internal surfaces of said first and second integral flange portions defining a part cylindrical recess, said flap being formed, at one edge thereof, with an integral cylindrical portion, which is connected to a main portion of the flap by a curved portion defining a recess, the part cylindrical recess in the frame defined by said first and second integral flange portions being shaped to receive said cylindrical portion of the flap and hingedly retain it for pivotal movement between an open position in which the opening of the frame is uncovered and a closed position in which said flap covers the opening, said second integral flange portion of the frame terminating close to a zone at which the curved portion of the flap connects integrally with the main portion of the flap, thereby substantially enclosing said cylindrical portion of the flap, said second integral flange portion being received in said recess defined by the said curved portion when the flap is in its open position, and the extremities of the frame, in the same plane as said opening in the frame, being bent up to seal the ends of the letter plate.

2. A letter plate as claimed in claim 1 wherein the frame and flap carry a magnet and keeper respectively or vice versa, said magnet and keeper being engageable when the flap is closed to hold the flap in its closed position.

* * * * *